United States Patent [19]

Ratter

[11] 4,133,451

[45] Jan. 9, 1979

[54] CONTAINER LINER

[75] Inventor: Henry Ratter, Runcorn, England

[73] Assignee: Imperial Chemical Industries Limited, London, England

[21] Appl. No.: 802,032

[22] Filed: May 31, 1977

[30] Foreign Application Priority Data

Jun. 1, 1976 [GB] United Kingdom ..... 22563/76

[51] Int. Cl.[2] ..... B65D 25/14; B65J 1/02

[52] U.S. Cl. ..... 220/461; 99/646 C; 105/423; 220/1.5; 220/403; 220/465; 220/470; 428/35

[58] Field of Search ..... 428/35; 93/36.01, DIG. 1; 99/317, 646 S, 646 C; 105/357, 423; 214/304, 305, 318; 220/1.5, 17, 63 R, DIG. 14, 403–404, 410, 460, 465, 461, 470; 298/24

[56] References Cited

U.S. PATENT DOCUMENTS

| | | | |
|---|---|---|---|
| 2,712,797 | 7/1955 | Woehrle et al. | 105/423 |
| 3,068,561 | 12/1962 | Jones | 105/423 |
| 3,128,904 | 4/1964 | Reilly | 220/404 |
| 3,163,434 | 12/1964 | Krueger | 105/423 |
| 3,167,209 | 1/1965 | Jones | 220/403 X |
| 3,756,469 | 9/1973 | Clark et al. | 105/423 X |
| 3,868,042 | 2/1975 | Bodenheimer | 220/403 |

*Primary Examiner*—Michael G. Wityshyn
*Attorney, Agent, or Firm*—Cushman, Darby & Cushman

[57] ABSTRACT

A liner constructed of pliable material and which is suitable for use with a container of the type which may be tipped in order to discharge a load of particulate material, the liner comprising at least one aperture through which it may be loaded with particulate material, at least in the region of the base of the liner an inner skin and an outer skin the inner skin being perforated to allow passage of gas, and at least one entry port through which gas may be introduced into the space between the inner and outer skins, in use gas introduced into the space between the inner and outer skins escaping through the perforations and causing fluidization of the particulate material thereby assisting discharge of the material from the liner.

10 Claims, 8 Drawing Figures

CONTAINER LINER

This invention relates to means for transporting finely-divided solid particulate material and in particular to an improved form of liner for a container useful in transporting such material.

Containers of the type which may be tipped in order to discharge their loads are used for transporting solid particulate material. Such containers may form part of a vehicle, or they may be mountable upon a vehicle, for example a trailer, and demountable therefrom such that they may be transported apart from the vehicle, e.g. by ship or by aircraft, or may be transferred from one vehicle to another. The vehicle may be for example a road or rail vehicle.

It is also known to install in such containers a liner of a pliable material which is able to conform substantially to the internal shape of the container and to charge the solid particulate material to the liner in the container. Prior to transporting other material in the container all that is required is for the particulate material to be discharged from the liner and for the liner to be removed from the container. Use of such a liner protects the container from the solid particulate material and ensures that the container does not have to be cleaned before it can be used for transporting other material.

In order to discharge a load of solid particulate material from such a lined container it is necessary to form an aperture in the liner in the container, for example, by forming a slit in the liner, and to tip the container. However, where the material is a finely-divided solid particulate material such a method of discharge may suffer from the disadvantage that it may be possible to discharge a part only of the load, even when the container is tipped to a large angle of elevation, for example, to an angle of 45° or more, and a proportion of the load, and in some cases a substantial proportion of the load, may remain in the lined container. Discharge of that part of the load remaining in the lined container cannot be effected merely by increasing the angle of elevation of the container as such as increase in the angle of elevation may tend to place the centre of gravity of the vehicle carrying the container outside of a line between the wheels of the vehicle thus making the vehicle itself unstable and liable to tip over. Indeed, a maximum angle of elevation for the container is set to ensure stability of the vehicle carrying the container and at such a maximum angle of elevation a load of finely-divided solid particulate material often cannot be discharged fully.

We have now found that discharge of such a load of finely divided solid particulate material may be assisted by fluidising the material and we have developed an improved form of liner for use in such a container and through which fluidisation of the material may be effected.

The present invention provides a liner which is constructed of a pliable material and which comprises at least one aperture through which the liner may be charged with finely-divided solid particulate material, at least in the region of the base of the liner an inner skin and an outer skin the inner skin being perforated to allow passage of gas, and at least one entry port through which gas may be introduced between the inner skin and the outer skin.

The liner is for use in a rigid container which container is itself suitable for use in transporting finely-divided solid particulate material.

In use the liner is installed in a suitable container and the liner is charged with finely-divided solid particulate material. To discharge the container the liner is breached, e.g. by slitting the liner at a point adjacent to an aperture in the container, the container is tipped and some of the particulate material is thereby discharged through the aperture, and gas, e.g. air, is then passed into the space between the inner and outer skins of the liner and thence into the particulate material remaining in the liner. The material is thereby fluidised in order to aid discharge of the material remaining in the liner.

The liner of the present invention is suitable for use in the transportation of many different types of finely-divided solid particulate material, for example, lime and soda ash. It is particularly suitable for use in transporting finely-divided calcium carbonate, for example, finely ground natural calcium carbonate or precipitated calcium carbonate, especially sub-micron size precipitated calcium carbonate. The calcium carbonate may be coated with a fatty acid, e.g. with stearic acid. The calcium carbonate may be, for example, coated calcium carbonate having a particle size in the range 50 to 100 millimicrons.

The liner may be used with a container of the type conforming to the specifications of the International Standards Organisation (ISO), that is, a box-like container in which the end walls have dimensions 8 ft by 8 ft and in which the base, side walls and top have dimensions of 8 ft by 20 ft, 30 ft or 40 ft. Container having other dimensions may be used. The top of the container may be provided with one or more sealable hatches through which the container may be filled and one of the end walls of the container may be provided with double doors which provide access to the container and permit the liner to be installed in the container. The doors themselves may be provided with one or more sealable hatches through which the liner and container may be discharged. Alternatively, a discharge hatch or hatches may be positioned in the end wall of the container opposite the doors.

The liner is made of a pliable material. Suitable materials are plastics materials, for example, polyethylene and poly(vinyl chloride). It is preferred that the plastics material is heat-sealable in order to simplify construction of the liner. Alternatively, the liner may be made of a woven material, for example it may be made of canvas or of a woven cotton material. The woven material may be rubberised.

The liner will generally be of dimensions substantially the same as the internal dimensions of the container with which it is to be used such that in use it is able to conform substantially to the internal shape of the container. For example, where it is to be used with an ISO container it will be of box-like shape when assembled and installed in a container and have an oblong-shaped base, square end walls, and oblong-shaped side walls. The liner may have an open top, in which case the open top will provide the aperture through which the liner may be charged with particulate material. However, it is preferred that the liner has a top containing one or more apertures positioned so as to correspond with the hatches in the top of the container to permit filling of the liner with solid particulate material. The apertures in the top of the liner may be capable of being sealed after the liner has been filled. The liner may be provided with suitable means for attaching it to the container, for example, loops fastened to the end and side walls and/or the top of the liner which may be attached to corresponding hooks on the walls and/or top of the container.

At least in the region of its base the liner is provided with an outer skin and an inner skin and at least one entry port through which gas may be introduced between the outer skin and the inner skin. The inner skin is perforated to allow passage of gas into the liner and through the finely-divided solid particulate material contained in the liner thereby causing fluidisation of the particulate material and assisting in removal of the material when the container is tipped. It is the base of the liner which comprises an outer and inner skin, that is, that part of the liner which is in contact with the finely-divided particulate material which remains to be discharged when the container is tipped to its greatest extent. A part only of the base of the liner may comprise an inner skin and an outer skin. However, it is preferred that substantially the whole of the base of the liner comprises an inner skin and an outer skin. The perforations suitably comprise holes of dimensions in the range 0.1 to 6 mm although the size of the perforations and the number of perforations per unit area in the inner skin will depend at least to some extent on the nature of the particle size of the material to be carried in the liner and the ease, or difficulty, with which it can be fluidised. A suitable size of perforations, and number thereof per unit area, may be determined by simple experiment.

The entry port through which gas may be introduced between the inner skin and the outer skin may be connected to a pipe which in use is itself connected to a gas supply, for example, a compressed air supply. When the liner is installed in the container the pipe which is attached to the entry port should be readily accessible such that when it is desired to fluidise the particulate material in the liner the pipe may readily be connected to a gas supply.

Where substantially the whole of the base of the liner comprises an outer skin and a perforated inner skin the inner skin may have a tendency to "balloon" when gas is passed into the space between the skins in order to effect fluidisation of the particulate material in the liner. "Ballooning" may cause the inner skin to break through the surface of the particulate material and a reduction in fluidisation efficiency may result. The tendency of the inner skin to "balloon" may be reduced if parts of the inner skin and the outer skin forming the base of the liner are sealed together. For example, in the case of a liner having an oblong-shaped base parts lengthwise of the base may be sealed together care being taken to ensure that the sealed parts do not prevent gas being passed to the unsealed sections of the space between the inner and outer skins when the liner is in use. The unsealed sections may be interconnected thus permitting gas to be supplied to all sections of the base from a single entry port.

When a container containing finely-divided solid particulate material in a liner of the type hereinbefore described is discharged the base of the liner eventually becomes exposed, and towards the end of the discharging process progressively larger areas of the base became exposed. As a part of the base becomes exposed the fluidising gas has a tendency to escape preferentially through the perforations in the part of the inner skin of the base which is exposed and which is not covered by the particulate material with the result that the efficiency of fluidisation of the particulate material remaining in the liner may be reduced. This reduction in efficiency may be obviated at least in part by arranging for the base of the liner to be comprised of discrete sections having a space between the inner and outer skins, the sections not being interconnected, and the sections each having a separate entry port through which gas may be introduced between the inner skin and outer skin. When a liner of this latter type is used, and as during discharge of particulate material an area of the base of the liner becomes exposed, the supply of gas to the section of the base of the liner corresponding to the exposed part of the inner skin is discontinued. As a progressively larger area of the base of the liner becomes exposed the supply of gas to further sections of the base is discontinued with the result that fluidisation efficiency is substantially maintained.

BRIEF DESCRIPTION OF THE DRAWINGS

A particular embodiment of the liner of the present invention will now be described with the aid of the following diagrams in which.

DETAILED DESCRIPTION OF THE PRESENTLY PREFERRED EMBODIMENTS

Figure 1:
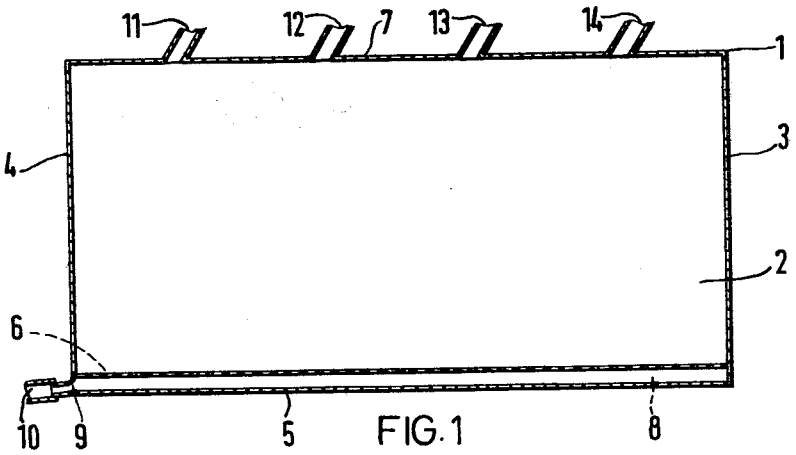
FIG. 1 shows a side view in cross-section of a liner.
Figure 2:
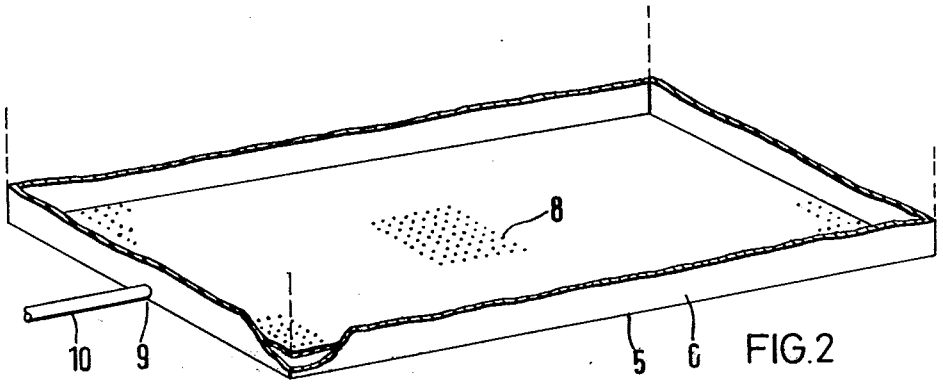
FIG. 2 shows a perspective view of a part only of the base a liner.
Figure 3:
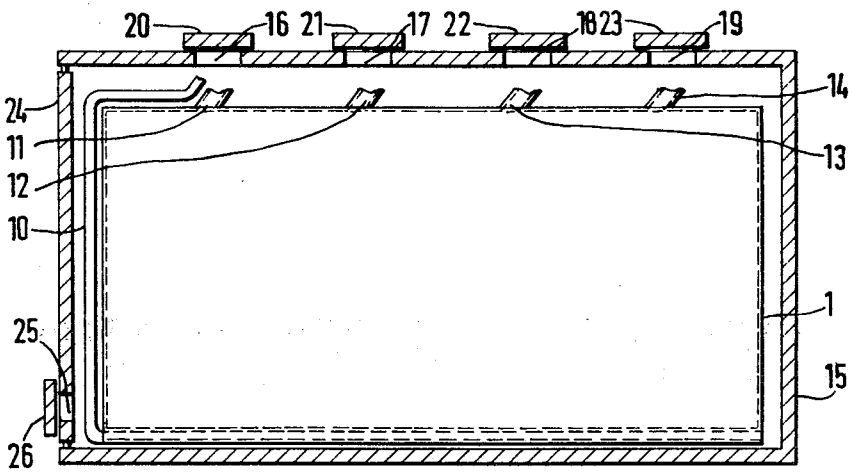
FIG. 3 shows a side view in cross-section of a liner installed in a container prior to filling with finely-divided solid particulate material.

Referring to FIGS. 1–3, the liner (1), which is made of 700 gauge polyethylene, comprises side walls (2), end walls (3, 4), a base made up of an outer skin (5) and an inner skin (6), and a top (7). The inner skin of the base comprises a plurality of holes (8) and leading to the space between the outer and inner skins of the base is an entry port (9) to which is attached a pipe (10). In the top of the liner are four apertures (11, 12, 13, 14) through which the liner may be charged with finely-divided solid particulate material.

The container (15) is of generally box-like construction and comprises in its top four hatches (16, 17, 18, 19) which carry cover plates (20, 21, 22, 23) respectively. One end of the container is sealed by a pair of pivotally-mounted doors (24) and in each door and near the base of the door are positioned two hatches (25, one not shown) which are sealed by cover plates (26, one not shown).

In use the container (15) is mounted on a vehicle (not shown), the doors (24) are opened, and the liner (1) is positioned in the container and attached to the walls and/or the top of the container by means which are not shown, care being exercised to position the liner such that the apertures (11 to 14) in the top of the liner are adjacent to the hatches (16 to 19) in the top of the container. The pipe (10) is also positioned so that it is accessible from the hatch (16). The doors of the container are then closed ensuring that the hatches (25) are sealed by the cover plates (26).

The cover plates (20 to 23) are removed from the hatches (16 to 19) and the liner is filled with finely-divided solid particulate material, for example stearate-coated precipitated calcium carbonate, through the apertures (11 to 14) in the top of the liner. When the liner is filled the apertures (11 to 14) are loosely closed by tucking the polyethylene which defines the apertures into the space between the top of the liner and the top of the container, and the container is sealed by replacing the cover plates (20 to 23).

In order to discharge the finely-divided solid particulate material from the container the hatches (25) in the doors of the container are opened, chutes (not shown) for delivery of material are attached to each hatch, and those parts of the liner adjacent to the hatches are slit. Because of the weight of the finely-divided particulate material in the liner those parts of the liner adjacent to the hatches will generally be pushed into the apertures of the hatches and thus the parts of the liner which it is necessary to slit will readily be located. The container is then tipped about an axis near that end of the container near the pivotally-mounted doors and the particulate material is discharged via the hatches (25). When the container has been tipped to its maximum angle of elevation and as much particulate material as possible has been discharged the pipe (10) is connected to a supply of compressed air and air is passed into the space between the outer skin (5) and the inner skin (6) of the base of the liner and outer through the holes (8) in the inner skin. The rate at which the air is supplied is adjusted so as to fluidise the particulate material remaining in the liner and to cause the material to be discharged from the liner. Alternatively, fluidisation of the particulate material in the liner may be started before the container has been tipped and the material may thus be fluidised during the tipping operation, or fluidisation may be started after some of the material has been discharged by tipping but before all of the material which may be discharged by tipping has actually been discharged. As the air passed into the liner must be able to escape from the liner and from the container the apertures (11 to 14) in the liner and the hatches (16 to 19) in the container must be opened during the fluidisation of the particulate material. When discharge of the material has been completed the doors (24) of the container are opened and the liner is removed from the container and discarded. The container is then ready for use in the transportation of other material.

Figure 4:
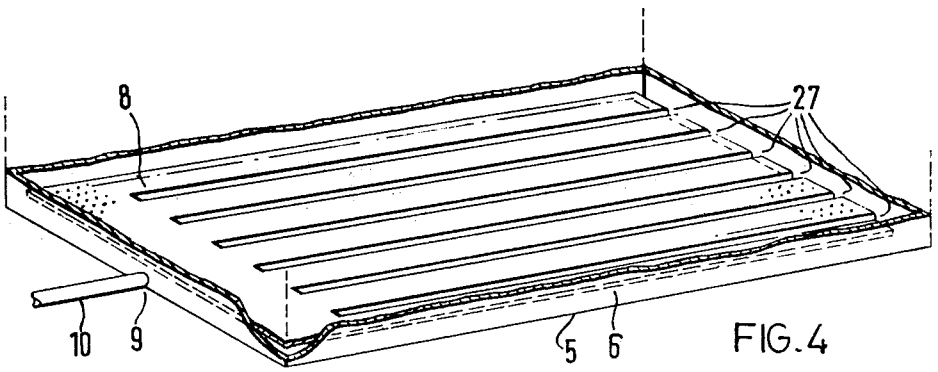
FIGS. 4 and 5 show perspective views of the bases only of different modified forms of liner of the type shown generally in FIGS. 1 to 3.

Referring to the modified form of liner shown in FIG. 4 there are a plurality of longitudinal sections (27) in which the outer skin (5) is sealed to the inner skin (6), for example, by heat sealing the polyethylene or by using a double sided tape. The longitudinal sections (27) in which the inner and outer skins of the base are sealed to each other do not quite span the entire length of the base and stop short of that edge of the base which carries the pipe (10). Thus, near the edge of the base which carries the pipe (10) the inner and outer skins of the base are not sealed to each other thus allowing a single pipe (10) to be used to provide air to all of the perforations in the inner skin of the base.

Use of a liner having a base modified in the manner shown in FIG. 4 ensures that when air is passed into the space between the inner and outer skins and fluidisation of the particulate material in the liner is effected there is no undesirable ballooning of the inner skin (6) of the base. If such ballooning does occur the inner skin (6) may break through the surface of the particulate material and the fluidisation effect will then be much reduced.

When a modified form of liner as shown in FIG. 4 is installed in a container the liner may be installed with that edge of the base which carries the pipe (10) remote from the discharge end of the container.

Figure 5:
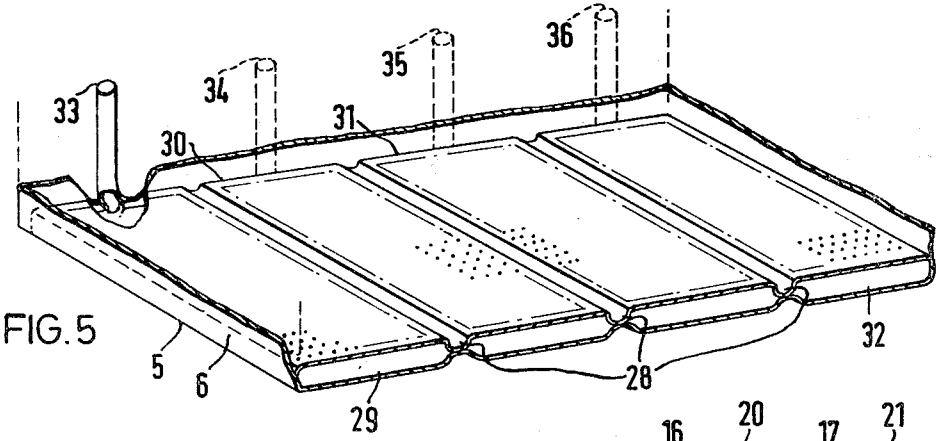

Referring to the modified form of liner shown in FIG. 5 there are three transverse parts (28) extending across the width of the base in which the outer skin (5) is sealed to the inner skin (6), for example by heat sealing the polyethylene or by using a double-sided tape. The transverse sealed parts divide up the base of the liner into four discrete sections (29, 30, 31, 32) in which there is a space between the outer skin and the inner skin. Each of these latter sections contains an entry port to which is attached a pipe (33, 34, 35, 36) through which air may be passed to the spaces between the inner and outer skins.

In use the liner is installed in a container of the type shown in FIG. 3 in the manner hereinbefore described, the pipes (33, 34, 35, 36) being positioned so that they are readily accessible from the hatches (16, 17, 18, 19) of the container, and the liner is filled with finely-divided solid particulate material in the manner described with reference to FIGS. 1 to 3.

In order to discharge the finely-divided solid particulate material from the container the hatches (25) in the doors of the container are opened, chutes (not shown) for delivery of material are attached to each hatch, and those parts of the liner adjacent to the hatches are slit. The container is then tipped about an axis near that end of the container near the pivotally-mounted doors and the particulate material is discharged via the hatches (25). When the container has been tipped to its maximum angle of elevation and as much particulate material as possible has been discharged the pipes (33, 34, 35, 36) are connected to a supply of compressed air and air is passed into the sections (29, 30, 31, 32) in which there is a space between the inner and outer skins. The rate at which air is supplied is adjusted so as to fluidise the particulate material remaining in the liner and to cause the material to be discharged from the liner. As the material is progressively discharged the inner perforated skins in the sections (29, 30, 31, 32) become uncovered. As this uncovering occurs the supply of air to the particular section uncovered is discontinued and the supply of air maintained only to those sections which remain covered by particulate material. Thus, in the embodiment shown in FIG. 5, if particulate material is to be discharged by tipping from that end of the liner containing section (29) then section (32) will be the first to be uncovered by particulate material and will be the first to which the supply of air is discontinued. The supply of air will next be discontinued to section (31) and then to section (30) and finally, and if necessary, to section (29).

Figure 6:
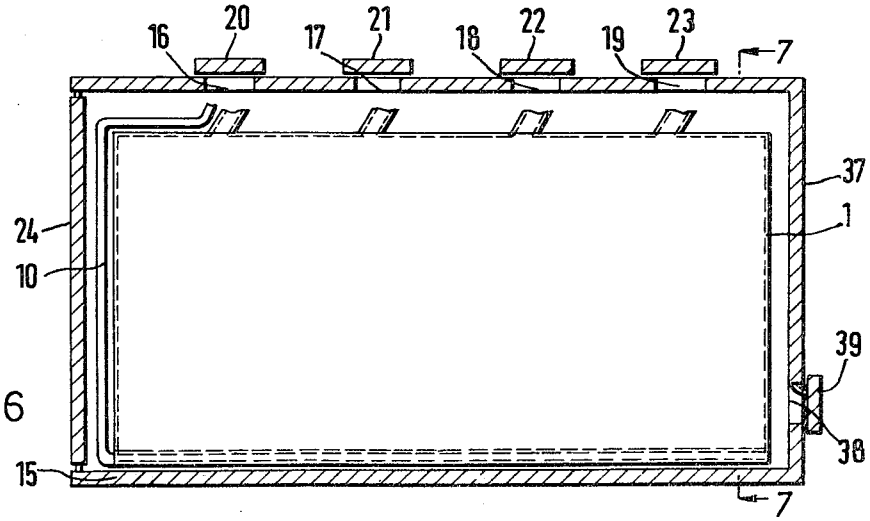
FIG. 6 shows a side view in cross-section of a liner installed in a container.
Figure 7:
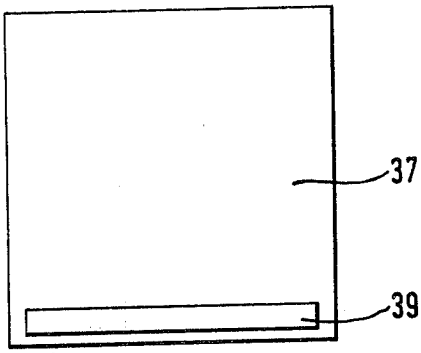
FIG. 7 shows an end view of the container of FIG. 6.
Figure 8:
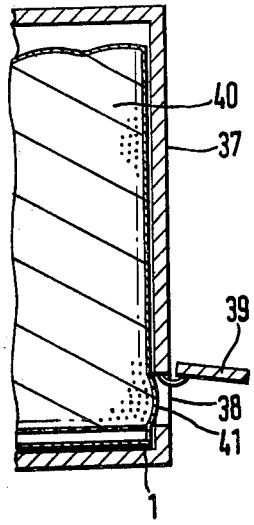
FIG. 8 shows a side view in cross-section of a part only of the liner and container of FIG. 6 (that part to the right of the dotted lines) the liner being filled with a finely-divided solid particulate material.

Referring to FIGS. 6 to 8, the liner is identical with that described with reference to FIGS. 1 to 3.

The container (15) is of generally box-like construction and comprises in its top four hatches (16, 17, 19, 19) which carry cover plates (20, 21, 22, 23) respectively. One end of the container is sealed by the pivotally mounted doors (24, one not shown) and the end wall (37) opposite to the pivotally-mounted doors comprises an elongated hatch (38) which is covered by a pivotally-mounted hatch cover (39).

In use the container (15) is mounted on a vehicle (not shown) and positioned with the pivotally-mounted doors remote from the power source of the vehicle (not shown). The liner (1) is then positioned in the container, the container is filled with finely-divided solid particulate material (40), and the container is sealed in the manner described with reference to FIGS. 1 to 3.

In order to discharge the finely-divided solid particulate material from the container the position of the container on the vehicle is reversed so as to position that end of the container containing the hatch (38) remote from the power source of the vehicle, the hatch cover (39) is raised, and a chute (not shown) is positioned in the hatch opening. Due to the weight of finely-divided particulate material in the liner that part of the liner (41) adjacent to the hatch (38) is pushed into the hatch opening. This part of the liner is slit lengthwise and the container is tipped about an axis near this delivery end of the container and the particulate material is discharged through the hatch (38). When the container has been tipped to its maximum angle of elevation and as much particulate material as possible has been discharged the pipe (10) is connected to a supply of compressed air and air is passed into the space between the inner and outer skins of the base of the liner in order to fluidise the particulate material and to assist its discharge.

It is to be understood that between the loading of the container with finely-divided solid particulate material and the discharge of the material from the container the container may have been removed from the vehicle and may have been transported by other means, for example, by ship or by aircraft.

I claim:

1. A liner constructed of a pliable material and which comprises at least one aperture through which the liner may be charged with finely-divided solid particulate material, at least in the region of the base of the liner an inner skin and an outer skin the inner skin being perforated to allow passage of gas, and at least one entry port through which gas may be introduced between the inner skin and the outer skin.

2. A liner as claimed in claim 1 in which the pliable material is a plastics material.

3. A liner as claimed in claim 2 in which the pliable material is polyethylene.

4. A liner as claimed in claim 1 which is of box-like shape comprising a base, end walls and side walls.

5. A liner as claimed in claim 4 having a top containing one or more said apertures.

6. A liner as claimed in claim 1 which is provided with means for attaching it to a container.

7. A liner as claimed in claim 4 in which substantially the whole of the base comprises an inner skin and an outer skin.

8. A liner as claimed in claim 7 in which sections of the inner skin and outer skin are sealed together.

9. A liner as claimed in claim 7 in which the base of the liner comprises discrete sections having a space between the inner and outer skins, the sections not being interconnected, and the sections each having a separate entry port through which gas may be introduced between the inner skin and outer skin.

10. A container having installed therein a liner as claimed in claim 1.

* * * * *